US006805343B2

(12) United States Patent
Kosugi

(10) Patent No.: US 6,805,343 B2
(45) Date of Patent: Oct. 19, 2004

(54) BILL HANDLING MACHINE FOR DETERMINING AMOUNT OF BILLS IN STORAGE BOXES

(75) Inventor: Yasutomo Kosugi, Seto (JP)

(73) Assignee: Hitachi, Ltd., Tokyo (JP)

( * ) Notice: Subject to any disclaimer, the term of this patent is extended or adjusted under 35 U.S.C. 154(b) by 119 days.

(21) Appl. No.: 10/022,336

(22) Filed: Dec. 20, 2001

(65) Prior Publication Data

US 2002/0079361 A1 Jun. 27, 2002

(30) Foreign Application Priority Data

Dec. 21, 2000 (JP) ..... 2000-388961

(51) Int. Cl.[7] ..... B65H 1/14
(52) U.S. Cl. ..... 271/147; 271/149; 271/160
(58) Field of Search ..... 271/145, 147, 271/148, 149, 160, 150

(56) References Cited

U.S. PATENT DOCUMENTS 4,524,268 A * 6/1985 Fukatsu ..... 235/379
4,681,229 A * 7/1987 Uesaka et al. ..... 209/534
4,795,889 A * 1/1989 Matuura et al. ..... 235/379
4,980,543 A * 12/1990 Hara et al. ..... 235/379
5,099,423 A * 3/1992 Graef et al. ..... 705/30
5,513,773 A * 5/1996 Cargill ..... 221/231
6,247,693 B1 * 6/2001 Kawano ..... 271/3.05
6,334,610 B1 * 1/2002 Minamishin et al. ..... 271/3.04
6,427,998 B1 * 8/2002 Norrie et al. ..... 271/145
6,533,261 B2 * 3/2003 Katou et al. ..... 271/3.12
6,722,486 B2 * 4/2004 Shibata et al. ..... 194/206
2003/0071048 A1 * 4/2003 Black et al. ..... 221/2

FOREIGN PATENT DOCUMENTS

JP 6-293467 * 10/1994 ..... B65H/43/06
JP 11-175801 7/1999

* cited by examiner

*Primary Examiner*—Donald P. Walsh
*Assistant Examiner*—Daniel K Schlak
(74) *Attorney, Agent, or Firm*—McDermott Will & Emery LLP

(57) ABSTRACT

A bill handling machine in which information of each of storing boxes installed therein is acquired and is reported to the operator includes a unit by which an amount of bills stored in each storing box set to the bill handling machine can be calculated by the storing box. The calculated amount of bills is compared with the number of bills beforehand inputted by the operator to thereby prevent an operation using a wrong number of bills.

20 Claims, 10 Drawing Sheets

BILL HANDLING MACHINE FOR DETERMINING AMOUNT OF BILLS IN STORAGE BOXES

BACKGROUND OF THE INVENTION

The present invention relates to a bill handling machine, and in particular, to a bill handling machine in which a bill storing box is attachable and detachable in the bill handling machine in operation.

For example, JP-A-11-175801 describes a conventional bill handling machine including a money receiving/paying port, a transport path, a money separating section, a temporary storing box, and money storing box. The money storing box of the bill handling machine includes a money receiving box, a money paying box, a recycle box, a charge/recovery box, and the like. The money storing box can be attached onto and detached from the bill handling machine.

In the conventional bill handling machine, when a money or bill storing box is attached onto the bill handling machine, for example, after a bill storing box used up to this point of time is detached therefrom, it is impossible for the bill handling machine to obtain information of the number of bills existing in the bill storing box thus attached onto the machine. Therefore, even if the bill storing box is full of bills installed by an operator, an operation to deposit money may possibly be conducted after the bill handling machine resumes its operation. In this situation, the machine tries to store the received bills in the bill storing box. This consequently may lead to an abnormal state depending on cases. On the other hand, even if the bill storing box is empty after an operator removes the bills therefrom, an operation to draw money may possibly be conducted after the bill handling machine resumes its operation. In this situation, the machine tries to obtain bills from the empty bill storing box. This possibly causes an abnormal state in some cases.

Additionally, when the bill storing box is installed on the bill handling machine as above, the machine cannot obtain information of a type of bills such as a 10000-Yen bill or a 1000-Yen bill and information of a type of the bill storing box such as a money receiving box, a money paying box, or a recycle box. Therefore, when the bill storing box is filled with bills of a type not expected by the bill handling machine, the machine possibly tries to obtain therefrom or to store therein bills of an unexpected type, which leads to an abnormal state in some cases. There may also occur a case in which the bill handling machine tries to store bills in a bill paying box or to obtain bills from a bill storing box, which also causes an abnormal state depending on cases.

SUMMARY OF THE INVENTION

It is therefore an object of the present invention, which has been devised to remove the above problems, to provide a bill handling machine capable of obtaining the information of the bill storing box installed therein and notifying the information to the operator.

To solve the problems, there is provided in accordance with the preset invention a bill handling machine for handling bills including a money receiving/paying section for receiving and paying bills, bill storing boxes including respective pushing plates to push bills stored therein, position sensors to detect positions of the pushing plates, and a storage for storing therein storing box information indicating types of the respective storing boxes; and a main controller. In operation of the bill handling machine, the storing boxes are removed from the bill handing machine and re-installed therein to fill bills in the boxes or to collect bills from the boxes. When an event in which the storing box is removed from the machine and is then re-installed therein is detected, the main controller receives signals from the storage and signals outputted from the position sensors when the pushing plate is driven, detects information of the storing box and information of the number of bills, and displays the detected results to report the condition.

BRIEF DESCRIPTION OF THE DRAWINGS

The present invention will be more apparent from the following detailed description, when taken in conjunction with the accompanying drawings, in which.

DESCRIPTION OF THE EMBODIMENTS

Referring now to FIGS. 1 to 10, description will be given of embodiments of the present invention.

Figure 1:
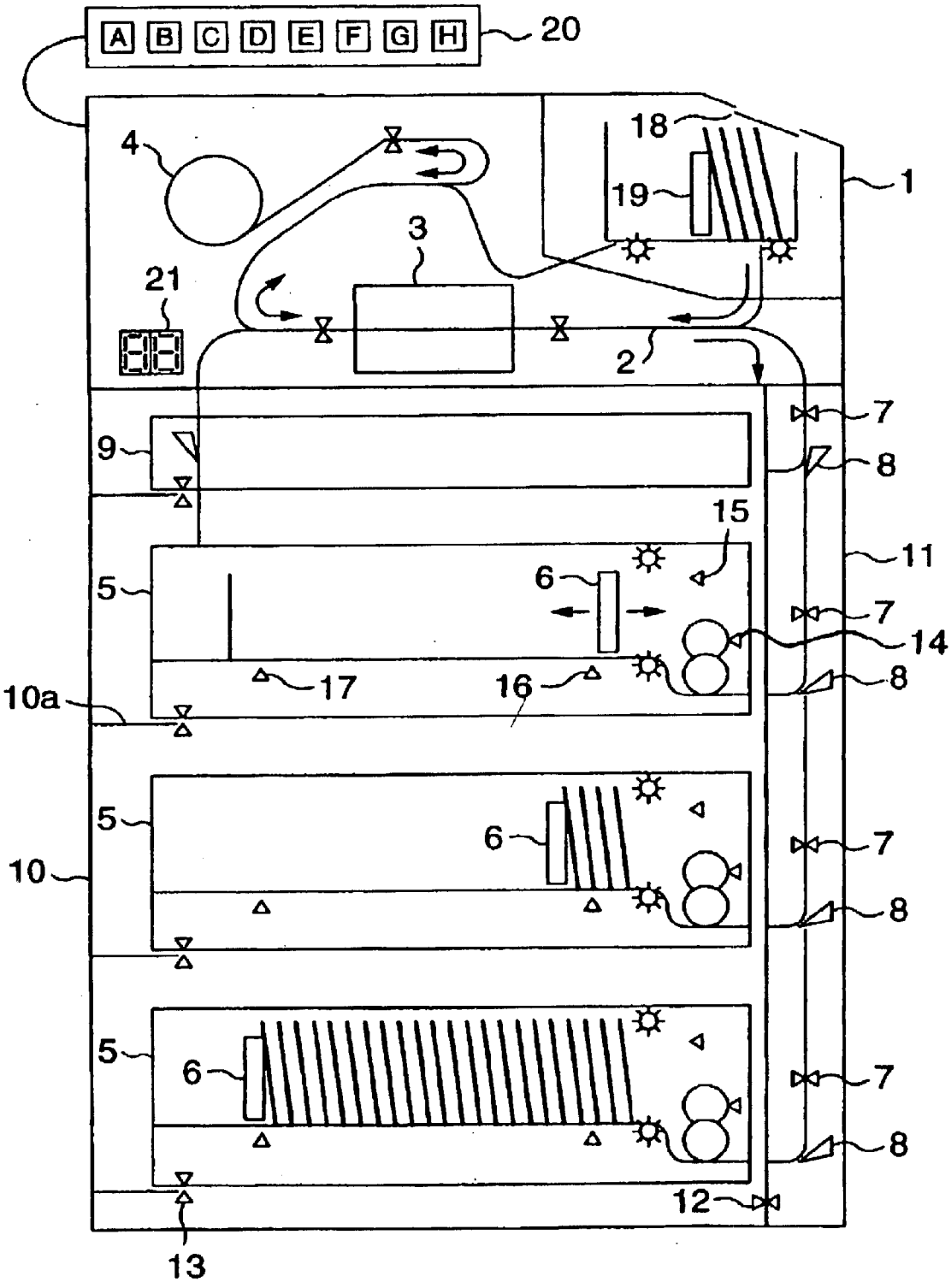
FIG. 1 is a schematic diagram showing an embodiment of a bill handling machine according to the present invention.
Figure 2:
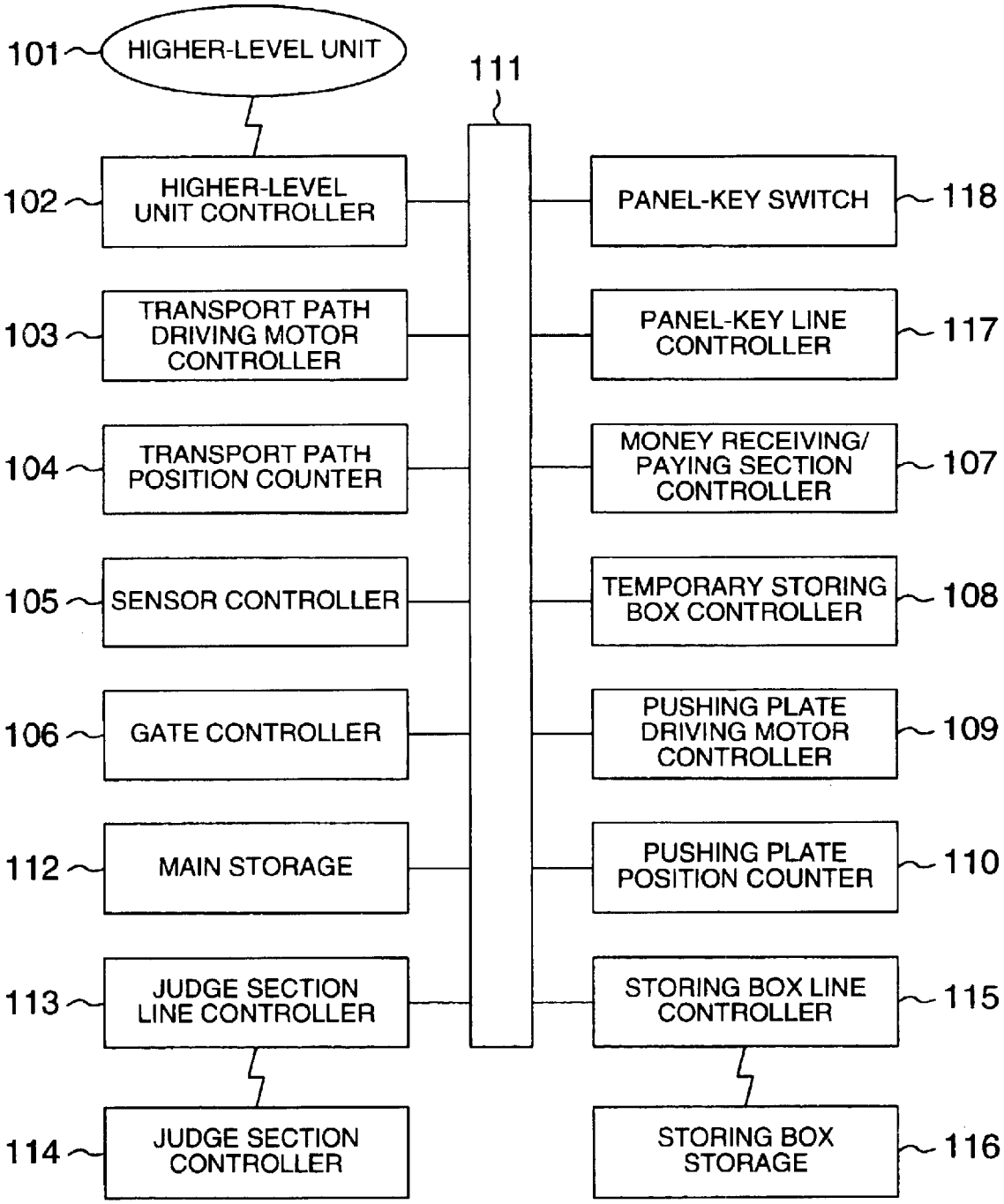
FIG. 2 is a diagram showing control blocks of the bill handling machine.

FIG. 1 shows a bill handling machine according to the present invention. FIG. 2 shows control blocks of the bill handling machine. These diagrams includes a bill or money receiving/paying section 1, a bill transport path 2 to transport bills to respective sections of the bill handling machine, a bill judge section 3 to make decision for truth or falsehood as well as a kind of each bill, to determine a bill appropriate for the payment, and to determine a bill as a rejected bill not suitable for the payment; a temporary bill storing box of winding type 4, a bill storing box 5, and a pushing plate 6 arranged in the bill storing box 5 to be driven by, for example, a motor to depress bills or to release the depressed state thereof. The pushing plate 6 includes a pushing plate position counter to detect a position of the plate 6 so that the position (the number of bills in the depressed state) is detected according to a count value of the counter.

The configuration of FIGS. 1 and 2 also includes a passage sensor 7 disposed in a transport path of bills to detect passage of a bill, a gate 8 to change a transport direction of a bill, a rejected bill storing box 9 to store a bill rejected by the judge section 3, a housing or cabinet 10 of the bill handling machine, an installing section 10*a* formed in the housing 10 to install a bill storing box, a door 11 of the cabinet 10, an open/close sensor 12 to detect opened and closed states of the door 11, a storing box position sensor 13 to detect whether or not the box is at an installation position, a pressure sensor 14, an empty state sensor 15 to detect an empty state of a storing box in which the storing box is empty, and pushing plate sensors 16 and 17 to detect the pushing plate to adjust a pushing position counter, which will be described later. The sensor 17 detects the pushing plate at a position at which the storing box is full of bills, and the sensor 16 detects the pushing plate at a position at which the bill storing box contains few bills. The pushing plate position counter detects the position of the pushing plate 6 and detects the number of bills in the bill storing box according to the detected position. The configuration further includes a shutter 18 disposed at an entrance of the money receiving/paying section 1, a money receiving/paying section pushing plate 19 which pushes the bills to hold the bills for reception or payment, and a panel key 20 for the operator to use when the bill handling machine is to be operated as a single unit. The system also includes a counter 21 to display an operation state of the panel key 20.

The configuration of FIGS. 1 and 2 further includes a higher-level unit 101 of the bill handling machine, a higher-level line connecting section 102 to establish connection to the higher-level unit 101, a motor controller 103 to drive the transport path, and a transport path position counter 104 to obtain an amount of shift of the transport path. The system also includes a sensor controller 105 to control sensors such a passage sensor to detect passage of a bill and a door open/close sensor to detect the opened and closed state of the door, a gate controller 106 to change the gate 8 according to a sense signal from the passage sensor 7 and the amount of shift of transport passage from the transport path position counter 104. The configuration further includes a money receiving/paying section controller 107 to control the money receiving/paying section 1, a temporary storing box controller 108 to control the temporary storing box 4, a pushing plate driving motor controller 109 to drive the pushing plate 6, a pushing plate shift amount counter 110 to obtain an amount of shift of the pushing plate 6, a main controller 111 to control respective sections of the bill handling machine, a main storage 112, a bill judge section controller 114 to control the bill judge section 3, and a bill judge section line controller 113 to establish connection to the bill judge section controller 114. The system of FIGS. 1 and 2 also includes a storing box storage 116 attached to a storing box to store information to identify the storing box and a storing box line controller 115 to establish connection to the storing box storage 116.

When the bill handling machine is used in a money depositing operation, the user installs bills in the money receiving/paying section 1. The section 1 feeds the bills in a bill-by-bill fashion to the transport path. The bill judge section 3 makes a judge for truth or falsehood and determines a type of bill of each bill. The section 3 then determines that the bill is appropriate for the payment or that the bill is not appropriate for the payment (a rejected bill) to select a storing destination of the bill. The rejected bill regarded as unacceptable by the bill judge section 3 is returned to the money receiving/paying section 1 so that the user receives the rejected bill out of the section 1. The bill regarded as acceptable by the bill judge section 3 is wound in the temporary storing box 4 to be temporarily stored therein. Thereafter, the pushing plate 6 of the storing box 5 is driven to reserve a space to store bills. The temporary storing box 4 is reversely driven to feed the bill to the transport path 2 to transport the bill. The transported bill is monitored by the passage sensors 7 over the passage path 2, and the gates 8 are changed according to the storing destination of the bill. That is, while the bill regarded as acceptable by the bill judge section 3 is stored in the storing box 5, the bill regarded as rejected by the bill judge section 3 is stored in the rejected bill storing box 9.

After the money depositing operation is repeatedly conducted, when the storing box 5 becomes full of bills, the operator opens the door 11 of the cabinet 10 of the bill handling machine and removes the storing box 5 from the installing section 10*a* to collect the bills. The operator installs the storing box 5, which is empty or which contains some bills, in the installing section 10*a* of the cabinet 10, closes the door 11, and resumes the operation.

In an operation to withdraw money, the bill handling machine obtains a bill from a storing box of bills of a specified type and feeds the bill in a bill-by-bill fashion to the transport path 2. The bill judge section 3 makes a judge for a type of bill and for truth or falsehood of the bill. While the rejected bill regarded as unacceptable by the bill judge section 3 is temporarily stored in the temporary storing box 4, only the bills regarded as acceptable is transported to the money receiving/paying section 1. Thereafter, the rejected bill is fed from the temporary storing box 4 to the rejected bill storing box 9.

After the withdrawal operation is repeatedly conducted, when the storing box 5 becomes empty, the operator opens the door 11 of the cabinet 10, takes out the storing box 5, and fills the storing box 5 with bills. The operator returns the storing box 5 to the installing section 10*a*, closes the door 11, and resumes the operation. The operator may closes the door 11 without returning the storing box 5 to resume the operation.

Figure 3:
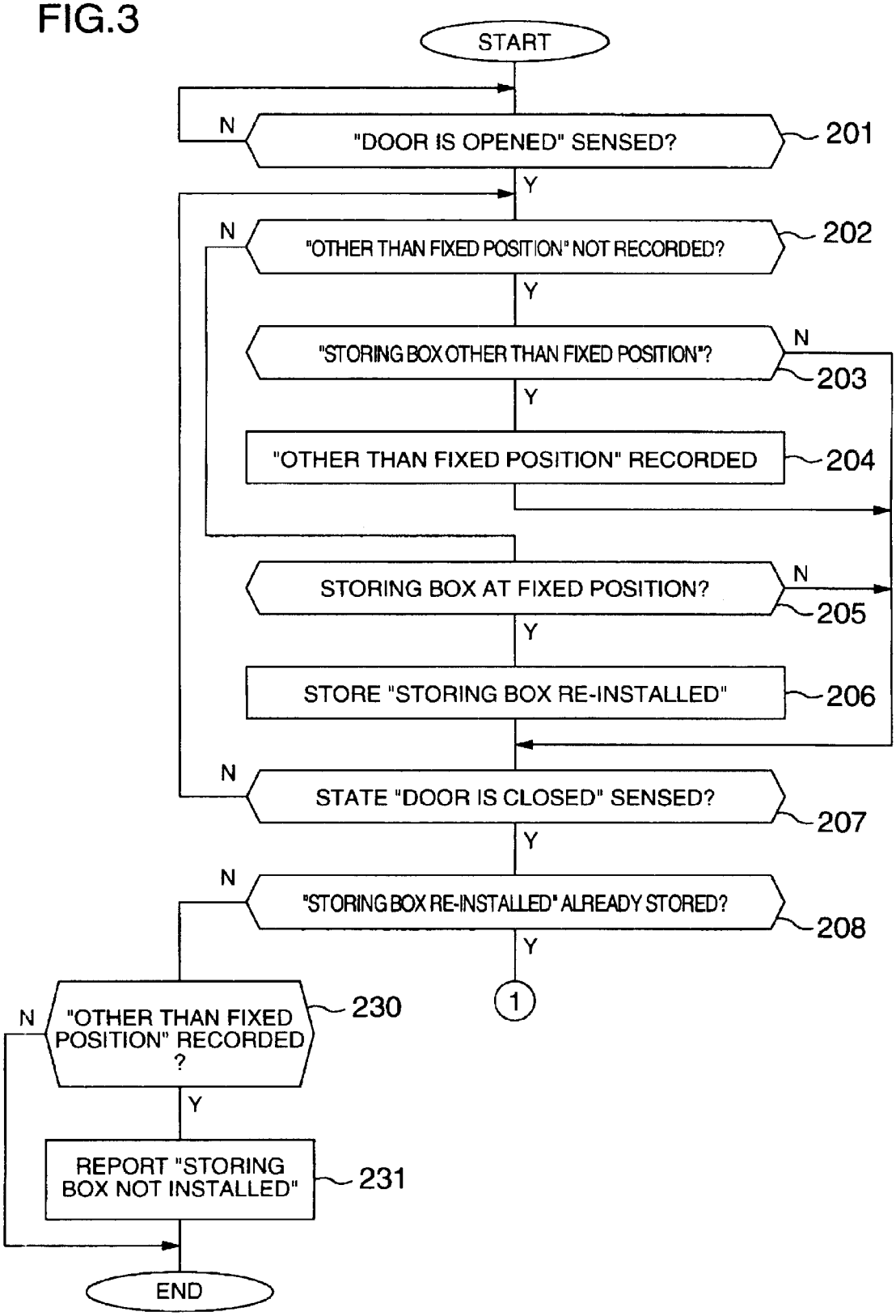
FIG. 3 is a flowchart showing operation of a main control section to obtain the number of remaining bills.
Figure 4:
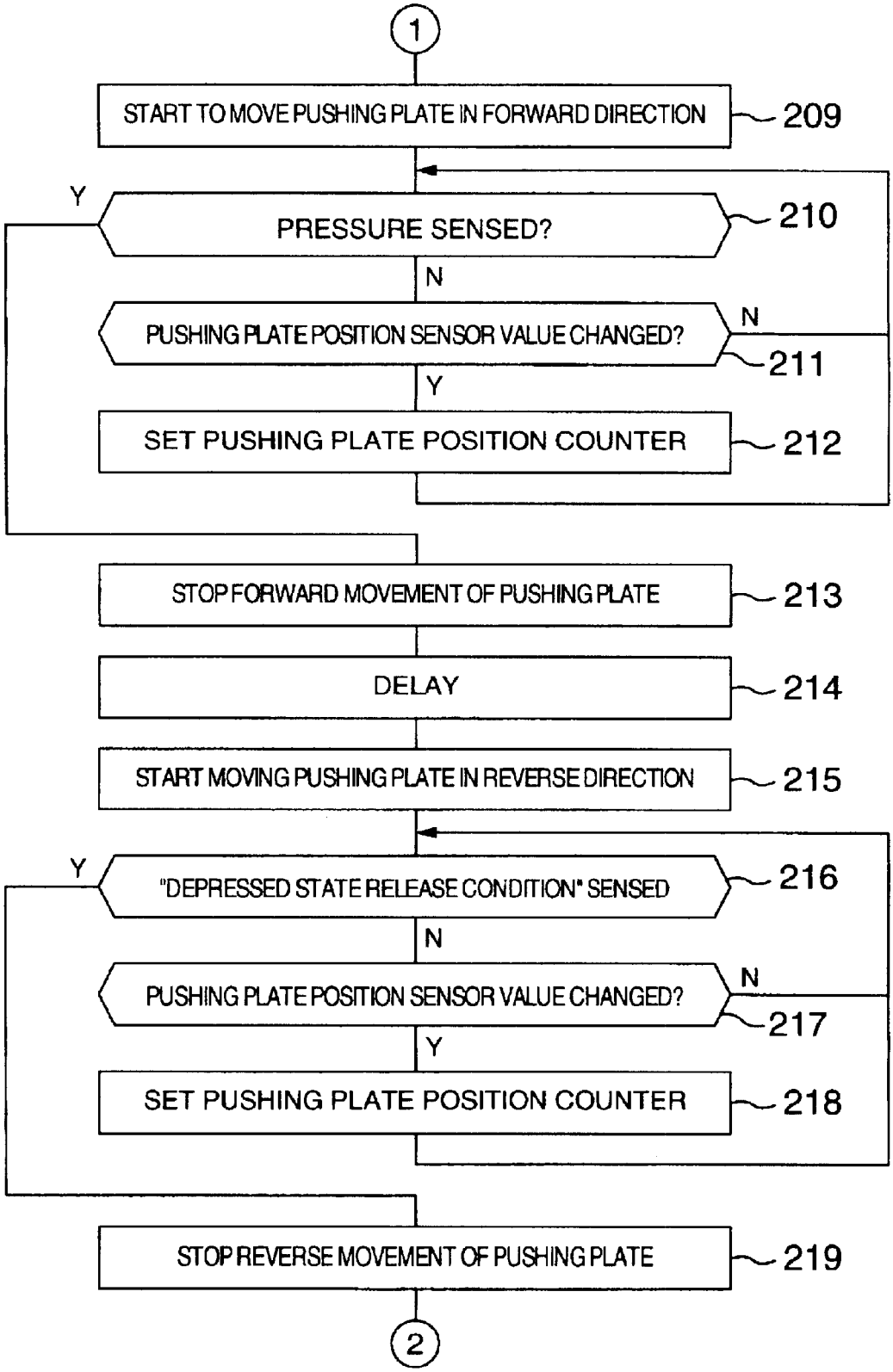
FIG. 4 is a flowchart showing operation of a main control section to obtain the number of remaining bills.
Figure 5:
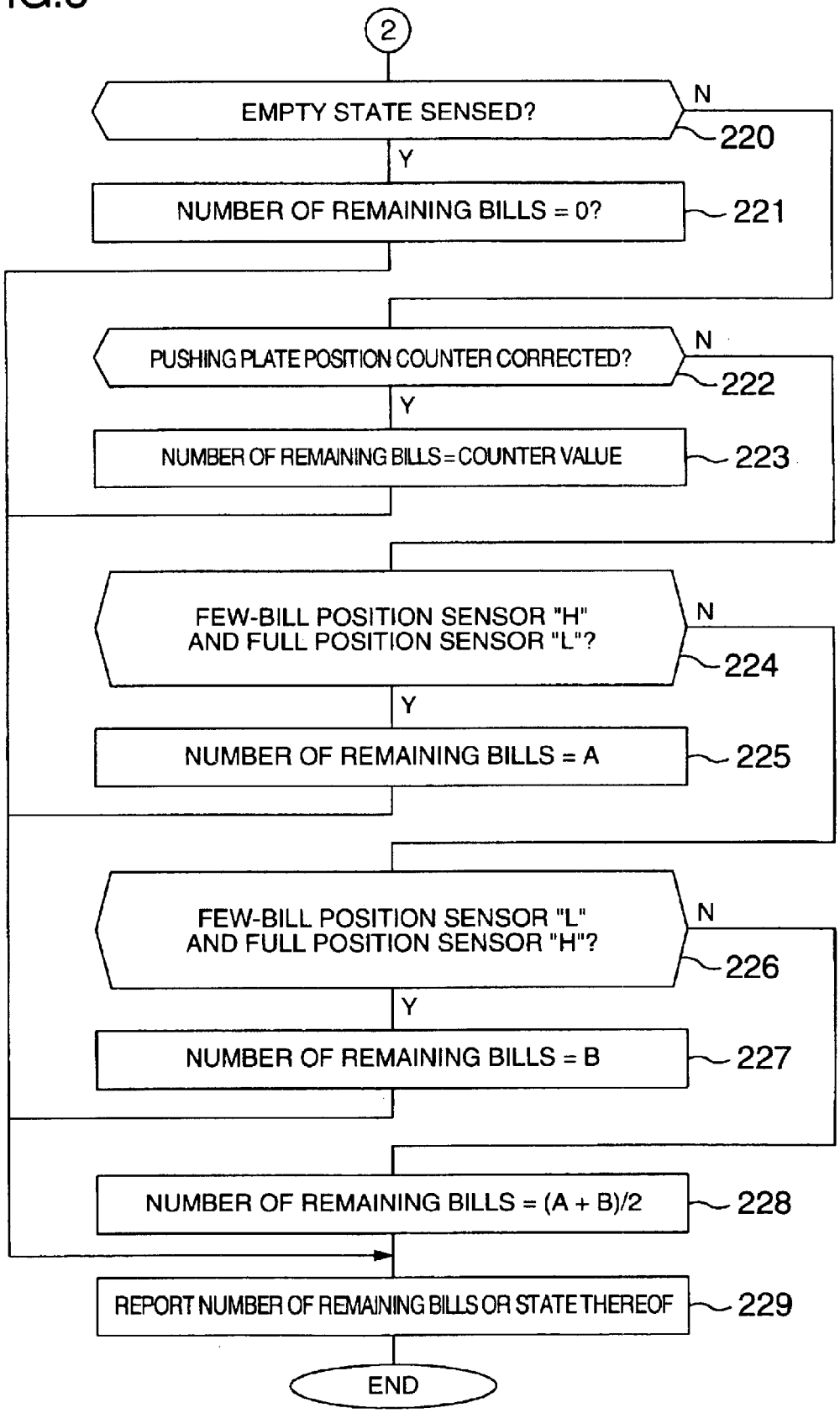
FIG. 5 is a flowchart showing operation of a main control section to obtain the number of remaining bills.

FIGS. 3 to 5 show processing of the main controller 111 to obtain the number of bills remaining in the storing box 5. Diagrams of FIGS. 6A to 6C and a graph of FIG. 6D show operation of the pushing plate 6 when the number of remaining bills is obtained.

Figure 6A:
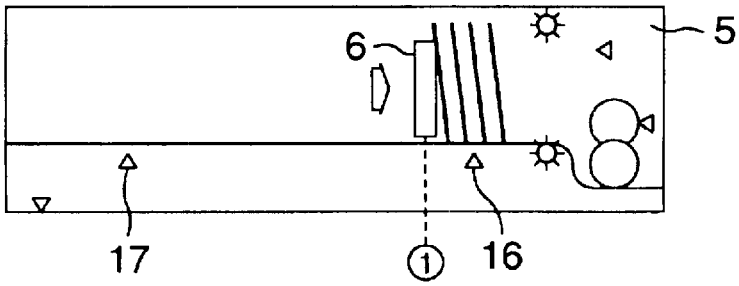
FIGS. 6A to 6C are diagrams showing operation of a pushing plate in an operation to obtain the number of remaining bills.
Figure 6B:
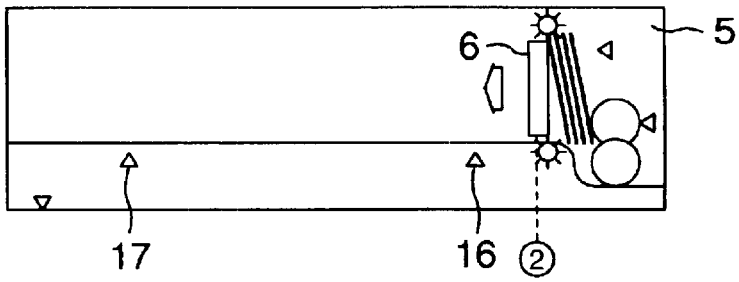
Figure 6C:
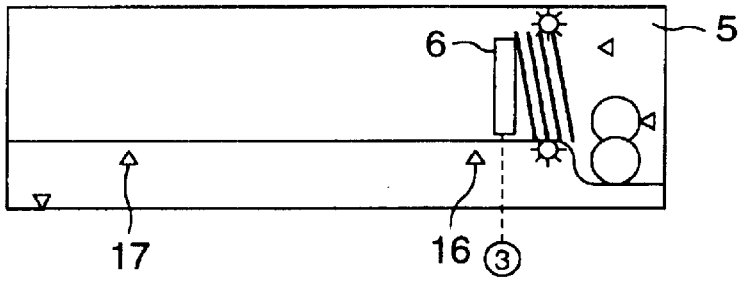
Figure 6D:
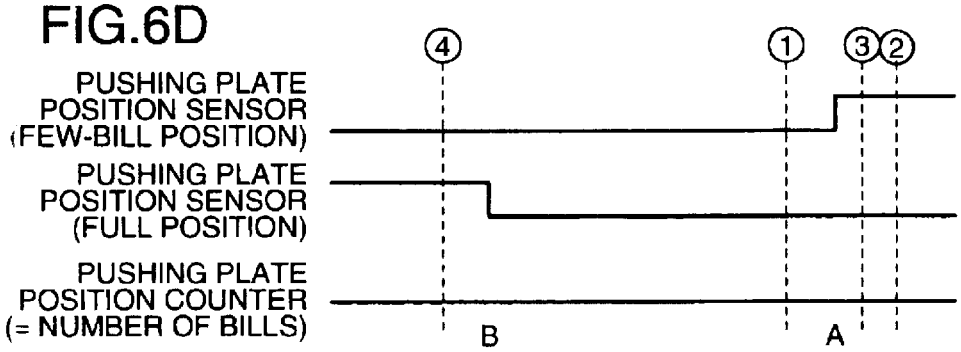
FIG. 6D is a graph for explaining an output from a pushing plate position sensor and a counting operation of a pushing plate position counter.

FIG. 6A shows an operation to drive the pushing plate 6 in a forward direction. The driving motor controller 109 controls the pushing plate driving motor to move the pushing plate 6 in a forward direction from a bill storing position (①) to a position (②) for the pressure sensor 14 to detect a pressure imposed on the bills as shown in FIG. 6D. FIG. 6B shows an operation to drive the pushing plate 6 in a reverse or backward direction. The driving motor controller 109 controls the pushing plate driving motor to move the pushing plate 6 in a reverse direction up to a position (③) at which the pressure sensor 14 detects a condition that the depressed state of the bills is to be released. FIG. 6*c* shows a position at which the pushing plate 6 is stopped. FIG. 6D is a graph for explaining an output from the pushing plate position sensor and an output of a count value from the pushing plate position counter. As can be seen from FIG. 6D, the output from the sensor is reversed at a full position (B) at which the storing box is full of bills and a few-bill position (A) at which only few bills are remaining in the storing box.

In step 201 of FIG. 3, the main controller 111 checks the sensor information from the sensor controller 105 to monitor the opened or closed state of the door 11. If the opened state of the door 11 is detected by an open/close sensor 12 (step 201), the main controller 111 refers to the main storage 112 to determine if the storing box 5 has been removed from the installation position, that is, if a condition "the storing box 5 is removed from the fixed position" has been stored in the main storage 112 (step 202). If the condition has been not stored, control proceeds to step 203; otherwise, control goes to step 205. The main controller 111 then determines using the storing box position sensor 13 whether or not the storing box 5 is at other than the fixed position, that is, in a condition "other than the fixed position" (step 203). If the condition is assumed, control proceeds to step 204; otherwise, control goes to step 207. The main controller 111 then stores the condition "other than the fixed position" in the main storage (step 204).

Also in step 205, the main controller 111 determines using the storing box position sensor 13 whether or not the storing box 5 is at other than the fixed position. If the storing box 5 is at the fixed position, control goes to step 206; otherwise, control goes to step 207. In step 206, a state that the storing box 5 has been returned to the installation position, that is, the storing box 5 has been reinstalled is stored in the main storage 112. In step 207, the main controller 111 determines whether or not a condition "the door 11 is closed" has been detected. If this is the case, control proceeds to step 208; otherwise, control proceeds to step 202. In step 208, the main controller 111 makes a retrieval through the main storage 112 to determine presence or absence of a record of "the storing box 5 has been re-installed". If the record is present, control goes to step 209 of FIG. 4; otherwise, control goes to step 230. In step 230, the main controller 111 makes a retrieval through the main storage 112 to determine presence or absence of a record of "other than the fixed position". If the record is present, control goes to step 231; otherwise, the processing is terminated. In step 231, the main controller 111 reports the state "the storing box 5 has not been installed yet" to the higher-level unit 101. The unit 101 displays the condition "the storing box 5 has not been installed yet" to notify the operator the condition for confirmation.

In step 209 of FIG. 4, the main controller 111 controls the pushing plate driving motor to move the pushing plate 6, for example, at a position (④) of FIG. 6 in the forward direction and makes a check to determine whether or not pressure has been sensed (step 210). If the pressure sensor 14 has sensed the pressure, control goes to step 213; otherwise, control goes to step 211. In step 211, the main controller 111 determines whether or not a pushing plate sensor 17 or 16 placed at the full position (B) or the few-fill position (A) has sensed the pushing plate 6. If the pushing plate 6 has been sensed, control goes to step 212; otherwise, control goes to step 210. In step 212, the main controller 111 sets the count value of the pushing plate position counter to the count value at the full position (B) or the few-fill position (A).

In step 213, the main controller 111 stops the forward movement of the pushing plate 6, delays the operation of the pushing plate 6 for a predetermined period of time (step 214), and then starts the reverse movement of the pushing plate 6 (step 215). The main controller 111 determines whether or not a pushing plate sensor 14 has sensed the depressed state release condition "release depressed state" (step 216). If the condition has been sensed, control goes to step 219; otherwise, control goes to step 217. In step 217, the main controller 111 determines whether or not the pushing plate sensor placed at the full position (B) or the few-fill position (A) has sensed the pushing plate 6. If the pushing plate 6 has been sensed, control goes to step 218; otherwise, control goes to step 216. In step 218, the main controller 111 sets the count value of the pushing plate position counter to the count value at the full position (B) or the few-fill position (A). In step 219, the main controller 111 stops the reverse movement of the pushing plate 6.

Next, in step 220 of FIG. 5, the main controller 111 determines whether or not the empty sensor 15 has sensed a state that the storing box 5 is empty. If the empty state is sensed, control goes to step 221; otherwise, control goes to step 222. When the empty state is detected, the main controller 111 sets the number of remaining bills to zero (step 221). In step 222, the main controller 111 determines whether or not the count value of the pushing plate position counter has been corrected. If the value has been corrected, control goes to step 223; otherwise, control goes to step 224. In step 223, the main controller 111 sets the number of remaining bills to the count value of the counter. In step 224, the main controller 111 determines whether or not the pushing plate sensor 16 placed at the few-bill position (A) produces an output at a high (H) level and the pushing plate sensor 17 placed at the full position (B) produces an output at a low (L) level. If the check results in "truth", control goes to step 225; otherwise, control goes to step 226. In step 225, the main controller 111 sets the number of remaining bills to a number of bills A corresponding to the few-bill position (A).

In step 226, the main controller 111 determines whether or not the pushing plate sensor placed at the few-bill position (A) produces an output at a low (L) level and the pushing plate sensor placed at the full position (B) produces an output at a high (H) level. If the check results in "truth", control goes to step 227; otherwise, control goes to step 228. In step 227, the main controller 111 sets the number of remaining bills to a number of bills A corresponding to the full position (B).

On the other hand, in step 228, the main controller 111 temporarily calculates the number of remaining bills as (A+B)/2. That is, since the counter is not corrected in these cases, the number of remaining bills is provisionally set as (A+B)/2. In step 229, the main controller 111 sends to the higher-level unit 101 a report of the state of remaining bills such as the number of bills counted or calculated, the empty state, the few-bill state, or the full state. According to the state of remaining bills, the higher-level unit 101 displays the state for the confirmation of the operator and/or to control the user at the bill handling machine or the bill handling operation for the storing box.

As above, to check the number of remaining bills in the storing box 5, the pushing plate 6 is moved in a forward direction (the number of remaining bills lowers in this direction) or in a reverse direction (the number of remaining bills increases in this direction) after it is confirmed that the storing box 5 is installed in the bill handling machine. Therefore, the amount or the number of remaining bills can be, although roughly, recognized.

Figure 7:
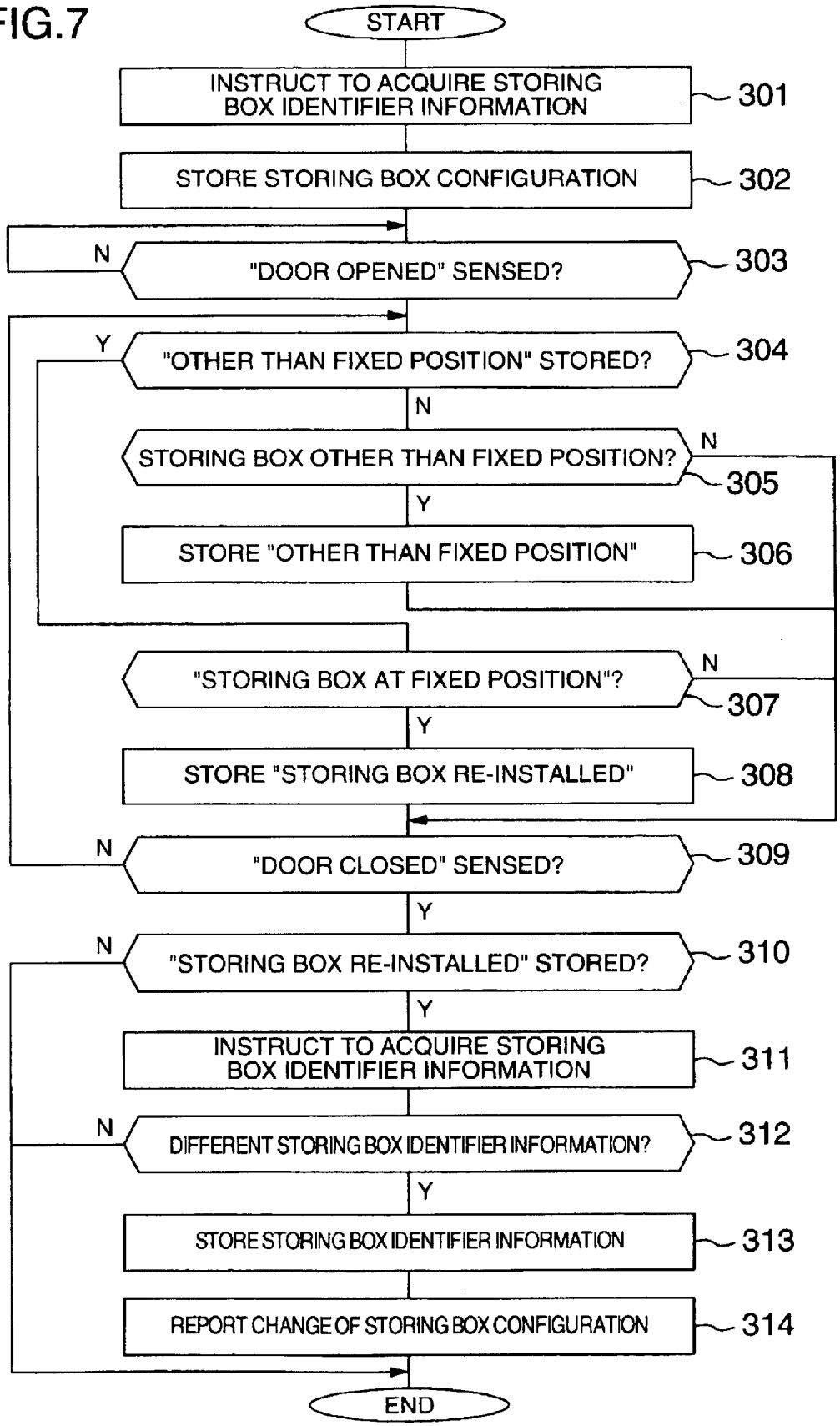
FIG. 7 is a flowchart showing operation of a main control section to recognize a bill storing box installed in a bill handling machine.

FIG. 7 shows a flow of processing of the main controller 111 to recognize the storing box 5 reinstalled in the bill handling machine. In step 301, after the bill handling machine is activated, the main controller 111 controls the storing box line controller 115 to acquire storing box identifier information stored in the storing box storage 116 such as information of a type of the storing box, namely, a money receiving box, a money paying box, or a recycle box and information of a bill type, namely, a 10000-yen bill, a 1000-yen bill, or a US-dollar bill. In step 302, the main controller 111 stores the obtained storing box identifier information in the main storage 112. In step 303, the door 11 is monitored whether or not the door is opened. When it has been detected that the door 11 is opened, control goes to step 304. In step 304, the main controller 111 makes a retrieval through the main storage 112 to determine whether or not the state "the storing box is at other than the fixed position" has been stored. If the state has been not stored, control goes to step 305; otherwise, control goes to step 307. In step 305, the main controller 111 determines whether or not the storing box is at other than the installed position, namely, at other than the fixed position. If the storing box is other than the fixed position, control goes to step 306; otherwise, control goes to step 309. In step 306, the main controller 111 stores the state "the storing box is other than the fixed position" in the main storage 112. In step 307, the main controller 111 determines whether or not the storing box is at the installed position, namely, at the fixed position. If the storing box is at the fixed position, control goes to step 308; otherwise, control goes to step 309. In step 308, the main controller 111 determines whether or not a state "the door has been closed" has been sensed. If the state has been sensed, control goes to step 310; otherwise, control goes to step 304.

In step 310, the main controller 111 makes a retrieval through the main storage 112 to determine whether or not a record "storing box re-installed" is present therein. If the record is present, control goes to step 311; otherwise, the processing is terminated. In step 311, the main controller 111 controls the storing box line controller 115 to acquire storing box identifier information stored in the storing box storage 116. In step 312, the main controller 111 determines if the obtained storing box identifier information before the re-installation of the storing box differs from that thereafter. If the information before the re-installation varies from that after the re-installation, control goes to step 313; otherwise, the processing is terminated. In step 313, the main controller 111 stores the updated storing box identifier information in the main storage 112. In step 314, the main controller 111 sends the updated storing box identifier information to the higher-level unit 101. The unit 101 displays the configuration of the installed storing box for the operator to confirm that the correct storing box has been installed.

Figure 8:
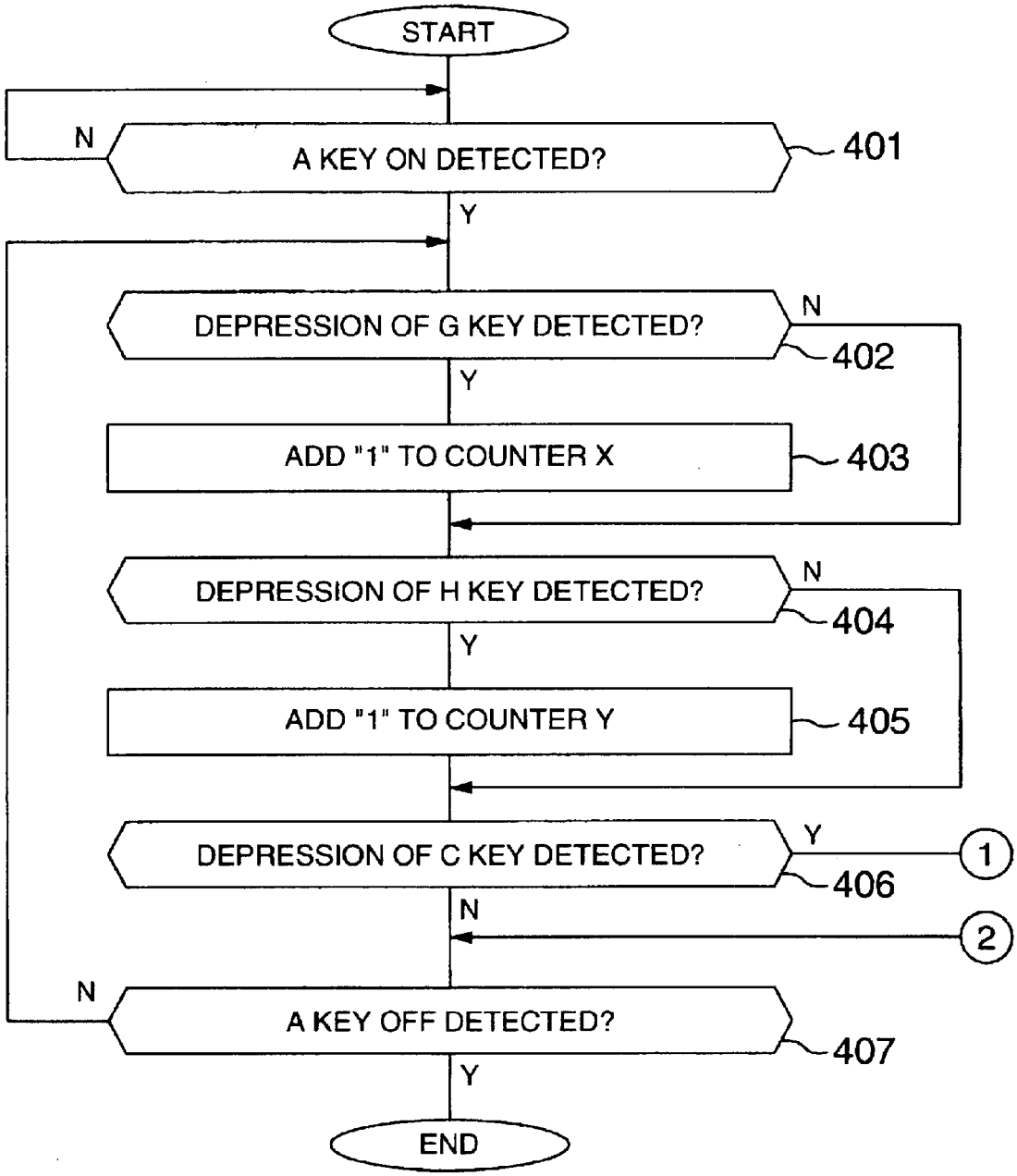
FIG. 8 is a flowchart showing operation of a main control section to store identifier information in a storing box identifier information storage.
Figure 9:
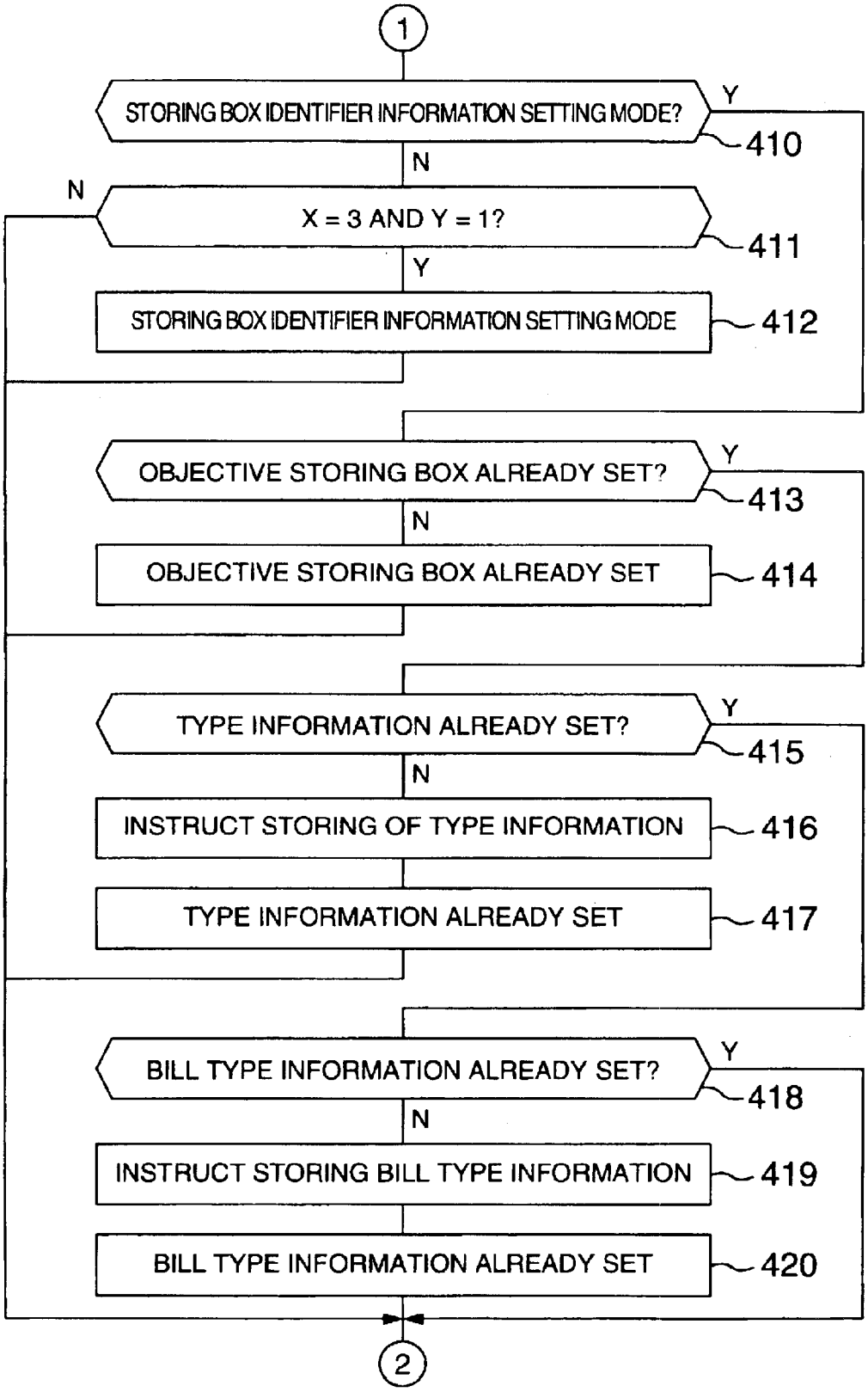
FIG. 9 is a flowchart showing operation of a main control section to store identifier information in a storing box identifier information storage.

FIGS. 8 and 9 show a processing flow of the main controller 11 to store the storing box identifier information in the storing box identifier information storage.

In step 401, the main controller 111 waits for a state that A key of the panel-key unit 20 is set to on. When A key is set to on, control goes to step 402. In step 402, whether or not G key has been depressed. If G key has been depressed, control goes to step 403; otherwise control goes to step 404. In step 403, for example, "1" is added to a count value X in a part of higher positions of the counter 21. In step 404, whether or not H key has been depressed is determined. If H key has been depressed, control goes to step 405; otherwise control goes to step 406. In step 405, for example, "1" is added to a count value X in a part of lower positions of the counter 21. In step 406, whether or not C key has been depressed is determined. If C key has been depressed, control goes to step 410 of FIG. 9; otherwise control goes to step 407. In step 407, whether or not A key is set to off is determined. If A key is set to off, the processing is terminated; otherwise, control goes to step 402.

In step 410 of FIG. 9, the main controller 111 determines whether or not the system is in a mode to set storing box identifier information. If the system is in the mode, control goes to step 413; otherwise, control goes to step 411. In step 411, the main controller 111 determines whether or not, a condition, for example, X=3 and Y=1 is already set. If this condition is set, control goes to step 412; otherwise, control goes to step 412.

In step 412, the system enters the storing box identifier information setting mode. In step 413, the main controller 111 determines whether or not, for example, a storing box number of the storing box as an object of operation to store the storing box identifier information has already been set. If the storing box number has been set, control goes to step 415; otherwise, control goes to step 414. In step 414, the main controller 111 sets the objective storing box number (i.e., the storing box number inputted by using G and H keys of the panel-key unit 20 is set to the main controller).

In step 415, the main controller 111 determines whether or not information of a type of the storing box is already set. If the type information is set, control goes to step 418; otherwise, control goes to step 416. In step 416, the main controller 111 instructs the storing box line controller 115 to store type information, e.g., a code of "02" indicating, for example, that the storing box is a bill receiving box. In step 417, the main controller 111 sets the type information (i.e., the type information inputted by using G and H keys of the panel-key unit 20 is set).

In step 418, whether or not information of a bill type of the storing box is already set is determined. If the bill type is determined, control goes to step 407; otherwise, control goes to step 419. In step 419, the main controller 111 instructs the storing box line controller 115 to store bill type information, e.g., a code of "10" indicating, for example, that the bill type of the storing box is "1000-yen bill". In step 420, the main controller 111 sets the bill type information (i.e., the bill type information inputted using G and H keys of the panel-key unit 20 is set).

As above, the number and the type of the storing box and the bill type of bills to be stored therein are set by operating the panel-key unit 20.

Figure 10:
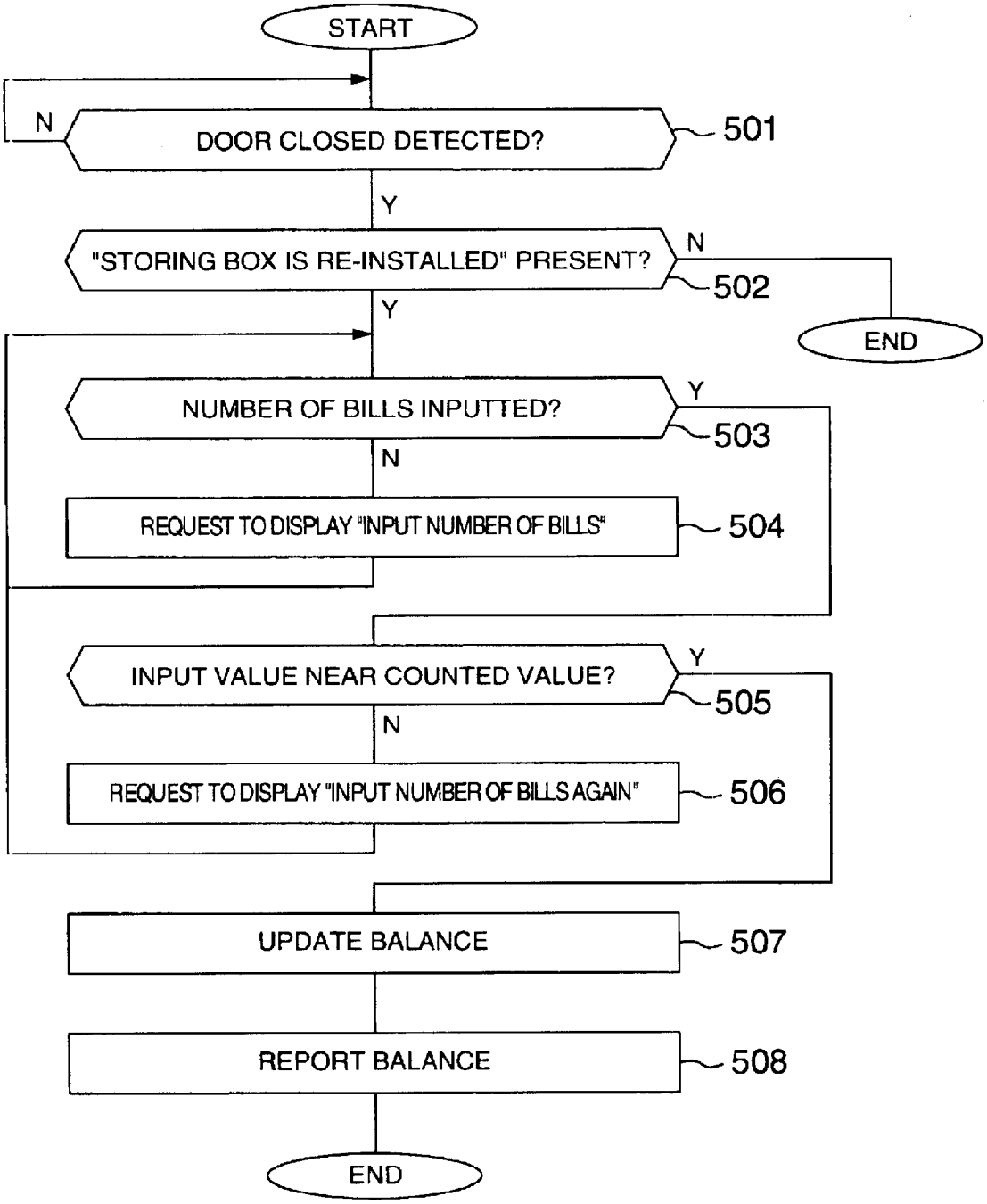
FIG. 10 is a flowchart showing operation of a main control section to control a balance of amount in the bill handling machine.

FIG. 10 shows a flow of processing of the main controller 111 to control the balance in the bill handling machine in which the bill storing box 5 can be detached from the machine and can be re-installed therein during its operation.

In step 501, the main controller 111 monitors the opened or closed state of the door. If the closed state of the door is detected, control goes to step 502. In step 502, the main controller 111 determines whether or not a record "storing box is reinstalled" exists in the main storage 112. If the record is present, control goes to step 503; otherwise, the processing is terminated.

In step 503, a check is made to determine whether or not the number of bills in the bill storing box re-installed by the operator at resumption of the operation is inputted. If an attempt is made to resume the operation without inputting the number of bills, control goes to step 504; otherwise, control goes to step 505. In step 504, the main controller 111 sends the condition "the number of bills has not been inputted" to the higher-level unit 101. The unit 101 displays a warning message to the operator "input the number of bills" to instruct the operator to input the number of bills.

In step 505, the main controller 111 compares the number of bills inputted by the operator with that counted or calculated as described above. If the comparison results in a large difference, control goes to step 506. If the comparison results in a small difference, control goes to step 507. The main controller 111 determines whether or not the comparison result is within a predetermined range in this way. In step 506, the main controller 111 notifies, to the higher-level unit 101, that the number of bills inputted by the operator is excessively larger or smaller than the number of bills in the re-installed bill storing box counted or calculated as above (FIGS. 4 and 5). The higher-level unit 101 displays a guidance message to the operator to again input the number of bills. In step 507, the balance of the bills in the storing box under control of the bill handling machine is replaced by the number of bills inputted by the operator. In step 508, the updated balance is sent to the higher-level unit 101.

As above, according to the embodiment, in a case in which after the operation of the bill handling machine is interrupted, when the operator conducts operations such as an operation to additionally fill the bill storing box with bills, an operation to remove bills therefrom, an operation to remove the bill storing box, and/or an operation to re-install the bill storing box in the bill handling machine, the number of remaining bills or the state of the remaining bills in the storing box can be calculated to be reported to the higher-level unit such that the state of the remaining bills in the box is displayed to the operator before the operation of the bill handling machine is resumed. Therefore, the operator can confirm the amount of bills remaining in the bill restoring box just re-installed. This also prevents an erroneous operation of the bill handling machine, and hence the transactions can be continuously processed without any system down of the bill handling machine.

When the operator installs a storing box of another type or another type of bills in the bill handling machine, it is possible before the operation is resumed that the configuration of the storing box can be again recognized and is reported to the higher-level unit to display the configuration of the storing box. Therefore, the operator can confirm the type of the storing box removed and re-installed, and hence a wrong operation of the bill handling machine can be prevented. The transactions can be continuously processed without causing a system down in the bill handling machine.

Additionally, the bill handling machine can cope with various different types of storing boxes and various types of bills, and hence can be directly handle various bills of foreign currencies.

By adopting a panel-key unit which is used when the bill handling machine is operated as a single unit, information to identify a bill storing box such as type information thereof, e.g., "bill receiving box", "bill paying box", or "recycle box" as well as information of a bill type of the bills stored in the bill storing box such as "10000-yen bill", "1000-yen bill", or "US-dollar bill" can be easily stored in the storing box storage.

Furthermore, by using a unit for the operator to input the number of bills to the bill handling machine, the balance can be controlled even when a bill storing box is removed therefrom and is re-installed therein.

In accordance with the present invention, there is provided a bill handling machine in which information regarding the bill storing box installed therein can be collected to be notified to the operator.

While the present invention has been described in detail and pictorially in the accompanying drawings, it is not limited to such details since many changes and modifications recognizable to those of ordinary skill in the art may be made to the invention without departing from the spirit and scope thereof.

What is claimed is:

1. A bill handling machine for handling bills, comprising:

a money receiving/paying section for receiving and paying bills;

a plurality of bill storing boxes for storing bills received from said money receiving/paying section or bills to be paid from said money receiving/paying section, said plurality of bill storing boxes including a pushing plate for depressing bills stored therein, respectively;

a transport path for linking said money receiving/paying section to said storing boxes and for transporting bills;

a storing box detecting unit for detecting an attaching state or a detaching state of at least one of the plurality of bill storing boxes;

a pushing plate detecting unit for detecting a position of said pushing plate; and a control section, wherein:

when said storing box detecting unit detects that said at least one of the plurality of storage boxes is in the attaching state, said control section causes said pushing plate in said at least one of the plurality of storage boxes to move by a driving motor; and said pushing plate detecting unit detects a position of said pushing plate for determining the amount of the bills stored in said at least one of the plurality of storage boxes.

2. The bill handling machine according to claim 1, wherein:

said pushing plate detecting unit includes a few-bill detecting section to detect a state of said at least one of the plurality of storage boxes when said at least one of the plurality of storage boxes contains a small amount of bills, and when said few-bill detecting section detects said pushing plate of said at least one of the plurality of storage boxes, said control section notifies a higher level unit of an amount of bills according to bills remaining in said at least one of the plurality of storage boxes.

3. The bill handling machine according to claim 1, wherein:

said pushing plate detecting unit includes a full state detecting section to detect a state of said at least one of the plurality of storage boxes in which said at least one of the plurality of storage boxes is full of bills, and when said full state detecting section detects said pushing plate of said at least one of the plurality of storage boxes, said control section notifies a higher level unit of an amount of bills according to the state in which said at least one of the plurality of storage boxes is full of bills.

4. The bill handling machine according to claim 1, wherein:

said pushing plate detecting unit includes a few-bill detecting section to detect a state of said at least one of the plurality of storage boxes when said at least one of the plurality of storage boxes contains a small amount of bills; and a full state detecting section to detect a state of said at least one of the plurality of storage boxes when said at least one of the plurality of storage boxes is full of bills, and said control section:

notifies a higher level unit of a first amount of bills corresponding to the position of said few-bill detecting section as an amount of bills stored in said at least one of the plurality of storage boxes, when said few-bill detecting section detects said pushing plate;

notifies said higher level unit of a second amount of bills corresponding to the position of said full state detecting section as an amount of bills stored in said at least one of the plurality of storage boxes, when said full state detecting section detects said pushing plate; and notifies said higher level unit of a third amount of bills corresponding to a half of sum of said first and second amount of bills as an amount of bills stored in said at least one of the plurality of storage boxes to, when neither said few-bill detecting section nor said full state detecting section detects said pushing plate.

5. The bill handling machine according to claim 1, further comprising:

a key input section to enable input by an operator;

a higher-level line connecting section connected to a higher-level unit for displaying a guidance; wherein:

when said at least one of the plurality of storage boxes detecting unit detects that said at least one of the plurality of storage boxes is in the attaching state, said control section determines whether or not the number of bills stored in the said at least one of the plurality of storage boxes is inputted in said key input section, and when said control section determines that the number of bills is not inputted, said higher-level unit displays a guidance for prompting the operator to input the number of bills to said key input section through said higher-level line connecting section.

6. The bill handling machine according to claim 1, further comprising a key input section in which an operator inputs a value corresponding to an amount of bills by operating keys;

wherein said control section compares the value indicating the amount of bills inputted by said key input with the amount of bills determined by driving said pushing plate.

7. The bill handling machine according to claim 6, wherein when a result of the comparison is within a predetermined range, said control section replaces the amount of bills controlled by the bill handling machine for said at least one of the plurality of storage boxes with the value indicating the amount of bills inputted by said key input.

8. The bill handling machine according to claim 6, wherein when a result of the comparison is beyond a predetermined range, said control section controls a display for indicating an instruction to input again a value indicating the amount of bills.

9. The bill handling machine according to claim 1, wherein when said storing box detecting unit detects the detaching state of said at least one of the plurality of storage and the attaching state of a corresponding storing box, said control section determines that the storing box is reinstalled.

10. The bill handling machine according to claim 9, wherein when said control section determines the reinstallation of said at least one of the plurality of storage boxes, said control section acquires storing box identifier information identifying said reinstalled storing box and determines whether or not the acquired storing box identifier information differs from storing box identifier information previously registered to said at least one of the plurality of storage boxes.

11. The bill handling machine according to claim 10, wherein the storing box identifier information identifying said reinstalled storing box and the storing box identifier information previously registered includes type information indicating a type of said storing box or bill-type information indicating a type of bills stored in said at least one of the plurality of storage boxes.

12. The bill handling machine according to claim 1, wherein said control section controls a motor to move said pushing plate in a forward direction of pushing bills stored in said at least one of the plurality of storage boxes and then when pressure to the bills is sensed, said control section controls the motor to move the pushing plate in a reverse direction.

13. The bill handling machine according to claim 1, further comprising a door open/close sensor for detecting an open/close state of a door of the bill handling machine;

wherein when said door open/close sensor detects that the door is in the close state, the motor is able to move said pushing plate.

14. A bill handling machine, comprising:

a money receiving/paying unit for receiving or for ejecting a bill;

a judge section for detecting a bill received from said money receiving/paying unit;

a temporary storing section for temporarily storing the bill detected by said judge section;

a plurality of storing boxes for storing bills received from said money receiving/paying unit or bills to be paid from said money receiving/paying unit; and a storing box detecting unit for detecting an attaching/detaching state of at least one of the plurality of bill storing boxes;

wherein when said storing box detecting unit detects that said at least one of the plurality of storage boxes is in the attaching state, a control section controls a pushing section disposed in said storing box to push bills and thereby calculating an amount of bills stored in said storing box.

15. The bill handling machine according to claim 14, wherein said pushing section of said at least one of the plurality of storage boxes comprises a pushing plate which travels in a forward direction and in a reverse direction in said storing box to depress bills storing in said at least one of the plurality of storage boxes.

16. The bill handling machine according to claim 14, further comprising a key input section in which an operator inputs an amount of bills by operating keys;

wherein said control section compares the amount of bills inputted by said key input with the amount of bills calculated.

17. The bill handling machine according to claim 16, wherein when said control section determines that a result of the comparison is within a predetermined range, said control section notifies a higher level unit of the amount of bills.

18. The bill handling machine according to claim 14, wherein said pushing section pushes the bills and then releases pressure to the bills.

19. A method for detecting amount of bills in a bill handling machine capable of attaching/detaching a plurality of storing boxes for storing bills, comprising:

detecting that at least one of the plurality of storing boxes is attached;

moving a pushing section disposed in said at least one of the plurality of storing boxes in a forward direction after detection by said first step;

detecting pressure by said pushing section and the bills due to movement by said moving step;

moving said pushing section in a reverse direction opposite the forward direction, when the pressure is detected by said detecting step; and detecting the amount of bills stored in said at least one of the plurality of storing boxes on the basis of a position of said pushing section after the step of moving said pushing section in the reverse direction is performed.

20. The method according to claim 19, further comprising:

detecting that said at least one of the plurality of storing boxes is detached; and determining that a reinstallation is completed, when the step of detecting that the storing boxes are attached is performed after the step of detecting that said at least one of the plurality of storing boxes is detached.

* * * * *